US009744762B2

(12) United States Patent
Guidotti et al.

(10) Patent No.: US 9,744,762 B2
(45) Date of Patent: Aug. 29, 2017

(54) ACTUATOR FOR A PRINTHEAD

(71) Applicant: I.C. S.R.L. CON SOCIO UNICO, Sassuolo (MO) (IT)

(72) Inventors: Gianmario Guidotti, Modena (IT); Giovanni Barbanti, Casalecchio di Reno (IT); Marco Faretra, Longiano (IT)

(73) Assignee: I.C. S.R.L. CON SOCIO UNICO, Sassuolo (IT)

( * ) Notice: Subject to any disclaimer, the term of this patent is extended or adjusted under 35 U.S.C. 154(b) by 0 days.

(21) Appl. No.: 14/909,378

(22) PCT Filed: Jul. 31, 2014

(86) PCT No.: PCT/IB2014/063583
§ 371 (c)(1),
(2) Date: Feb. 1, 2016

(87) PCT Pub. No.: WO2015/015451
PCT Pub. Date: Feb. 5, 2015

(65) Prior Publication Data

US 2016/0193832 A1 Jul. 7, 2016

(30) Foreign Application Priority Data

Jul. 31, 2013 (GB) ..... 1313741.9

(51) Int. Cl.
*B41J 2/045* (2006.01)
*B41J 2/14* (2006.01)

(52) U.S. Cl.
CPC ..... *B41J 2/14* (2013.01); *B41J 2/14201* (2013.01); *B41J 2202/05* (2013.01)

(58) Field of Classification Search
CPC ..... B41J 2202/05; B41J 2/14; B41J 2/14201; B41J 2/04581; B41J 2002/14225; B41J 2002/14266; B41J 2/1607
USPC ..... 347/9, 14, 44, 54, 68
See application file for complete search history.

(56) References Cited

U.S. PATENT DOCUMENTS

| | | | |
|---|---|---|---|
| 5,518,179 | A | 5/1996 | Humberstone et al. |
| 7,931,212 | B2 | 4/2011 | Urich et al. |
| 8,511,581 | B2 | 8/2013 | Urich et al. |
| 2002/0179873 | A1 | 12/2002 | Schmauser et al. |
| 2006/0097068 | A1 | 5/2006 | Urich et al. |
| 2006/0207591 | A1 | 9/2006 | Gallem et al. |

(Continued)

FOREIGN PATENT DOCUMENTS

| | | | |
|---|---|---|---|
| EP | 1386672 | A1 | 2/2004 |
| EP | 1972450 | A2 | 9/2008 |

(Continued)

*Primary Examiner* — Jannelle M Lebron
(74) *Attorney, Agent, or Firm* — Pearne & Gordon LLP

(57) ABSTRACT

An actuator (1) comprising: an actuating element (2); a first mounting (3) and a second mounting (4), configured for allowing the actuating element (2) to be positioned on a reference plane (P); characterized in that: the first mounting (3) is operable to allow the actuating element (2) to move in a direction (X) substantially parallel to the reference plane (P) and to allow a portion of a first end of the actuating element (2) to rotate about a first axis of rotation (T) substantially perpendicular to (X), thereby minimising wear between the actuating element (2) and the first mounting (3) during actuation.

19 Claims, 6 Drawing Sheets

(56) References Cited

U.S. PATENT DOCUMENTS

| | | | |
|---|---|---|---|
| 2011/0139150 | A1 | 6/2011 | Gallem et al. |
| 2011/0155768 | A1 | 6/2011 | Urich et al. |
| 2012/0139996 | A1 | 6/2012 | McNestry |
| 2013/0074832 | A1 | 3/2013 | Gallem et al. |
| 2013/0222448 | A1* | 8/2013 | Donahue ..... B41J 2/17523 347/9 |
| 2013/0242007 | A1 | 9/2013 | McNestry |
| 2015/0037501 | A1 | 2/2015 | Aparisi et al. |

FOREIGN PATENT DOCUMENTS

| | | | |
|---|---|---|---|
| EP | 2548655 | A1 | 1/2013 |
| ES | 2386267 | A1 | 8/2012 |
| WO | 9310910 | A1 | 6/1993 |

* cited by examiner

ACTUATOR FOR A PRINTHEAD

The present invention refers to an actuator; in particular, it refers to an actuator comprising a piezoelectric element, and at least a first mounting configured for allowing the piezoelectric element to be supported on a reference plane.

Many electromechanical actuators are known for use in inkjet printing applications, e.g. piezoelectric materials, electrostatic actuators etc.

The application of a given electric field to an unrestrained piezoelectric element results in its highest possible deformation at that field. This amount of deflection is dependent on the element geometry (thickness, span of the element), its specific material, crystallinity and poling, the field strength and direction of field applied etc. Where the element is clamped or impeded by other layers, a degree of free deflection is lost and the device operates at reduced efficiency compared to the unrestrained element.

The properties of piezoelectric materials have been known for some time as being particularly advantageous for use in printheads.

Printheads known in the art use piezoelectric elements, configured as an actuating beam having an obturator attached thereto, whereby the beams are usually restrained in a fluid chamber by securing the piezoelectric elements to elastomer support elements e.g. by use of a glue.

For example, EP1972450B discloses an example of a conventional printhead 100 used to print a glaze 104 as shown in section in FIG. 1. The printhead 100 comprises a fluid chamber 102, having a fluid inlet (not shown) and fluid outlet (not shown), whereby the glaze 104 flows through the chamber 102 from the input to the output under a pressure of e.g. 1 bar.

The printhead 100 comprises an actuator 106 in the form of a piezoelectric bar having an obturator 107 coupled thereto and located inside the chamber 102, whilst the printhead 100 further comprises a nozzle portion 108 having a surface inside the chamber 102 and having at least one through-hole nozzle 109 therein providing a flow pathway from inside the chamber 102 to a substrate 110 through the nozzle 109.

An obturator is any mechanical element which is operable to engage with a nozzle(s)/nozzle portion in a printhead to provide a mechanical seal at the entrance to the nozzle, thereby preventing/restricting the flow of a fluid into the nozzle(s).

As the obturator 107 is coupled to the actuator 106, it moves in the same direction of deflection of the actuator 106, and is configured to engage with the nozzle portion 108 to close the nozzle 109 when the actuator 106 is in a non-deflected position, and to disengage from the nozzle portion thereby uncovering the nozzle 109, when the actuator is in a deflected position, whereby such action effects drop ejection from the nozzle 109, towards a substrate 110.

An electronic control unit (not shown), is used to drive the actuator with a certain voltage waveform e.g. to drive the actuator 106 such that it deflects in an oscillatory manner at a certain frequency e.g. 1 kHz. By oscillating the actuator 106 it is possible to control the ejection of the fluid from the nozzle 109 in the form of droplets.

The chamber 102 is provided with an elastomeric seal 112 secured by glue to the piezoelectric bar, to prevent the glaze exiting the chamber 102 at any location other than the nozzle 109, and through the fluid inlet and outlet, whereby the elastomeric seal 112 is also operable to support the actuator 106 in the chamber 102.

Such a configuration makes it possible reduce wear on the piezoelectric actuator, because the elastic properties of the elastomeric seal compensate for the variations in length of the piezoelectric actuator itself and dampens the impact of the valve with the nozzle inlet area.

However, the fact that the support elements are made of elastomeric material has some disadvantages. For example, there is a significant dissipation of energy from the actuating element onto the elastomer supports as a result of damping, and/or the elastomer constrains the motion of the piezoelectric bar, which reduces the efficiency of the system.

Furthermore, the behaviour of the piezoelectric bar is strongly influenced by the particular configuration of mounting and it is therefore very difficult to obtain a production process which ensures the repeatability of behaviour of the piezoelectric bar.

Finally, the positioning of the piezoelectric bar in a printhead chamber is very important in order to provide reliable droplet deposition. Whilst it is possible to fabricate components with high precision using available micromachining techniques, such techniques are complicated and expensive e.g. micro-electrical discharge machining, laser fabrication, etching etc. Furthermore, it is also possible to create highly accurate robotic assembling equipment to assemble the components in a precise and accurate manner, but such equipment is expensive.

An additional difficulty is provided by the piezoelectric element being located inside the fluid chamber. This poses constraints and additional burdens on the design to ensure adequate protection of electrode layers and lead-outs to prevent corrosion and/or damage due to fluid incompatibility with the materials of actuator element leading to shorting and/or failure. This may be a particular problem with abrasive fluids of an aqueous nature and potentially containing metal particles required in colour glazes.

Consequently, in this context, the technical problem at the base of the present invention is therefore to create an actuator, for example a piezoelectric actuator, which addresses the above problems.

The technical problems relating to the known art are substantially addressed by an actuator like the one described in claim 1.

In a first aspect there is provided, an actuator comprising: an actuating element; a first mounting and a second mounting, configured for allowing the actuating element to be positioned on a reference plane (P); characterized in that: the first mounting is operable to allow the actuating element to move in a direction (X) parallel to the reference plane (P) and to allow a portion of a first end of the actuating element to move about a first axis of rotation (T) perpendicular to the direction of sliding (X).

Such an actuator provides excellent repeatability of operation of the piezoelectric actuator, without causing substantial wear on the piezoelectric actuator itself.

Such an actuator also provides improved repeatability of operation, independently of the uncertainties of the production processes used to fabricate the piezoelectric actuator, and which provides a reduction of wear on the piezoelectric actuator during actuation.

Preferably the second mounting is configured to allow a portion of a second end of the actuating element to move about a second axis of rotation (R) perpendicular to the direction of sliding and parallel to the first axis of rotation.

Preferably, the actuating element is a piezoelectric actuator element.

The positions of the first and second mountings can in fact be precisely defined with respect to the reference plane, independently of the uncertainties of production process of the piezoelectric actuator. Furthermore, the piezoelectric element does not scrape either on the first mounting, or on the second mounting, so that all wear is substantially eliminated.

Preferably, the first mounting comprises a roller having a central axis, operable to rotate about the first axis of rotation.

Preferably the movement of the actuator element about the first axis of rotation is a rotation movement.

Preferably the movement of the actuator element about the second axis of rotation is a rotation movement.

Preferably, the central axis of the roller is located below the plane.

Preferably the roller is configured for rolling in a direction parallel to the direction of sliding.

In this way, the first mounting has a form which is such as to optimize the contact with the piezoelectric element in order to reduce any frictional wear during operation. In other words the first mounting leaves the piezoelectric element free to deform without relative scraping movements being able to occur between it and the roller.

Preferably the roller is locatable in a groove which extends along a direction parallel to the first axis of rotation, said groove being elongated in a direction perpendicular to the direction of sliding.

Preferably, the first mounting comprises an elastic element configured to exert a force on the actuating element which presses it into contact with the roller.

In this way, contact is assured between the piezoelectric element and the roller during movement of the piezoelectric element.

Furthermore, since it does not have to perform coupling functions, the elastic element connected to the first mounting can be optimized in order to reduce the energy-dissipating effects to a minimum, so as not to alter the functionality of the piezoelectric actuator.

Preferably, the elastic element is made at least partially of an elastomeric material.

Preferably, the second mounting comprises a surface of substantially arched or curved shape, arranged to maintain the actuator element on the reference plane and structured to allow the actuating element to rotate about the second axis of rotation.

Preferably, the second mounting comprises an elastic element configured to exert a force on the actuating element which presses it into contact with said surface of substantially arched shape.

Preferably, the elastic element is made at least partly of an elastomeric material.

The same considerations as made above with reference to the elastic element connected to the first mounting are also valid for the elastic element connected to the second mounting.

Preferably, the second mounting comprises a stop surface, operable to allow the actuating element to be positioned along the direction of sliding.

Preferably the stop surface is at some distance from the surface of substantially arched shape in order not to interfere with the deformation of the piezoelectric element.

Preferably, the second mounting comprises a space configured for housing inside it at least one end portion of the first or second end of said actuating element during its said rotation about the second axis of rotation.

Preferably, the actuating element is operable to deflect without scraping on said at least one roller of said first mounting and to deflect without scraping on said surface of substantially arched shape of said second mounting.

The extent of the deformation/movement of the piezoelectric actuator depends on the driving voltage, without being influenced by stresses introduced by the mountings e.g. friction.

Preferably, the actuating element has an elongated structure.

In a second aspect there is provided a printhead having at least one actuator comprising: an actuating element; a first mounting and a second mounting, configured for allowing the actuating element to be positioned on a reference plane; characterized in that: the first mounting is operable to allow the actuating element to move in a direction of sliding parallel to the reference plane and to allow a portion of a first end of the actuating element to move about a first axis of rotation perpendicular to the direction of sliding.

In a third aspect there is provided a printer having at least one actuator comprising: an actuating element; a first mounting and a second mounting, configured for allowing the actuating element to be positioned on a reference plane; characterized in that: the first mounting is operable to allow the actuating element to move in a direction of sliding parallel to the reference plane and to allow a portion of a first end of the actuating element to move about a first axis of rotation perpendicular to the direction of sliding.

In a fourth aspect there is provided a printer having at least one printhead having at least one actuator comprising: an actuating element; a first mounting and a second mounting, configured for allowing the actuating element to be positioned on a reference plane; characterized in that: the first mounting is operable to allow the actuating element to move in a direction of sliding parallel to the reference plane and to allow a portion of a first end of the actuating element to move about a first axis of rotation perpendicular to the direction of sliding.

In a fifth aspect there is provided a method of inkjet printing on a substrate, the method comprising using the printer having at least one actuator comprising: an actuating element; a first mounting and a second mounting, configured for allowing the actuating element to be positioned on a reference plane; characterized in that: the first mounting is operable to allow the actuating element to move in a direction of sliding parallel to the reference plane and to allow a portion of a first end of the actuating element to move about a first axis of rotation perpendicular to the direction of sliding to deposit a fluid on the substrate.

Preferably the fluid is glaze or engobe.

The invention is explained below in more detail with reference to the attached drawings which represent exemplary and non-limiting embodiments thereof.

Figure 1:
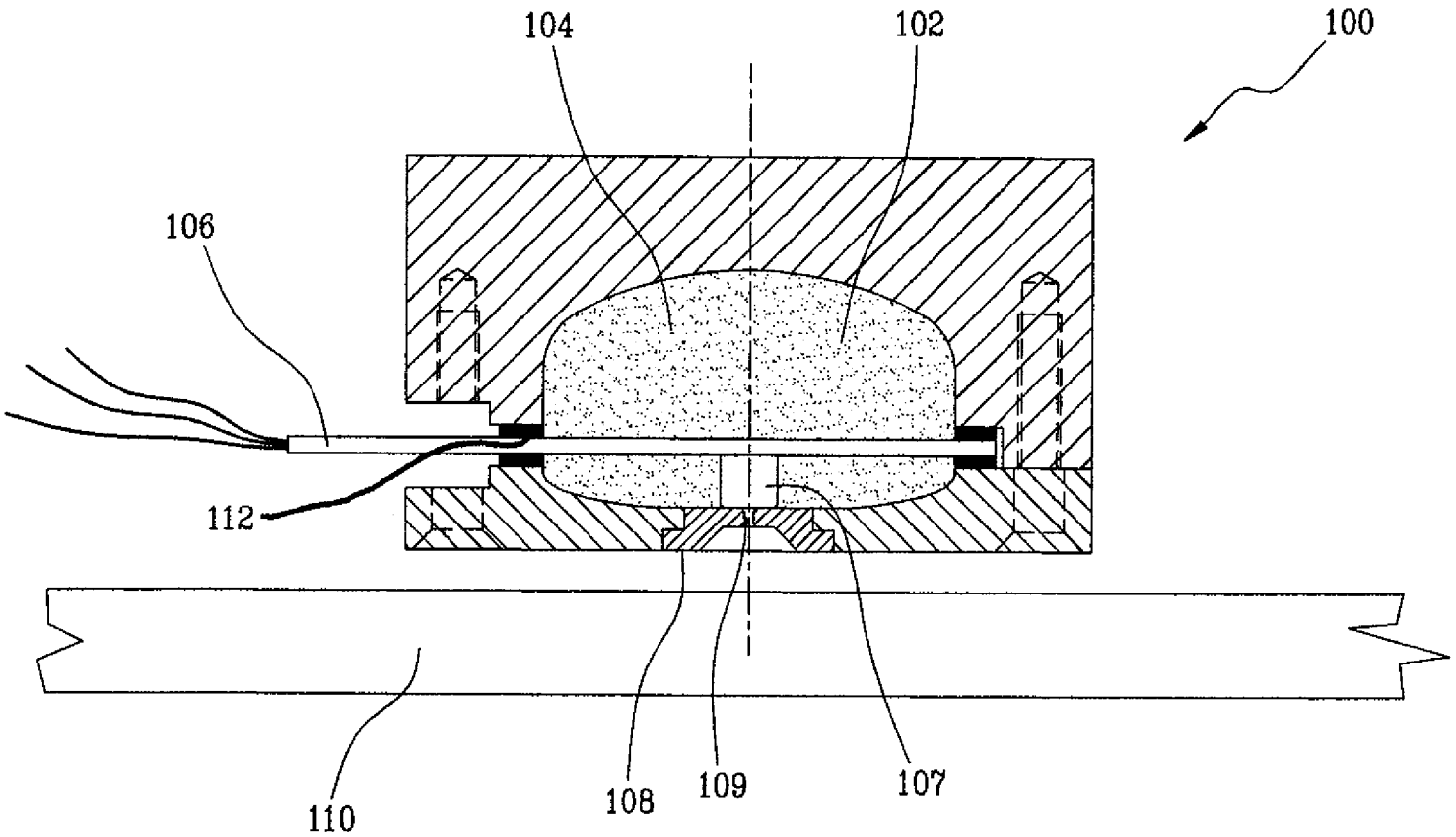
Figure 1 (Prior Art)
FIG. 1 shows in section an example of a conventional printhead of the prior art used to print glaze.
Figure 2:
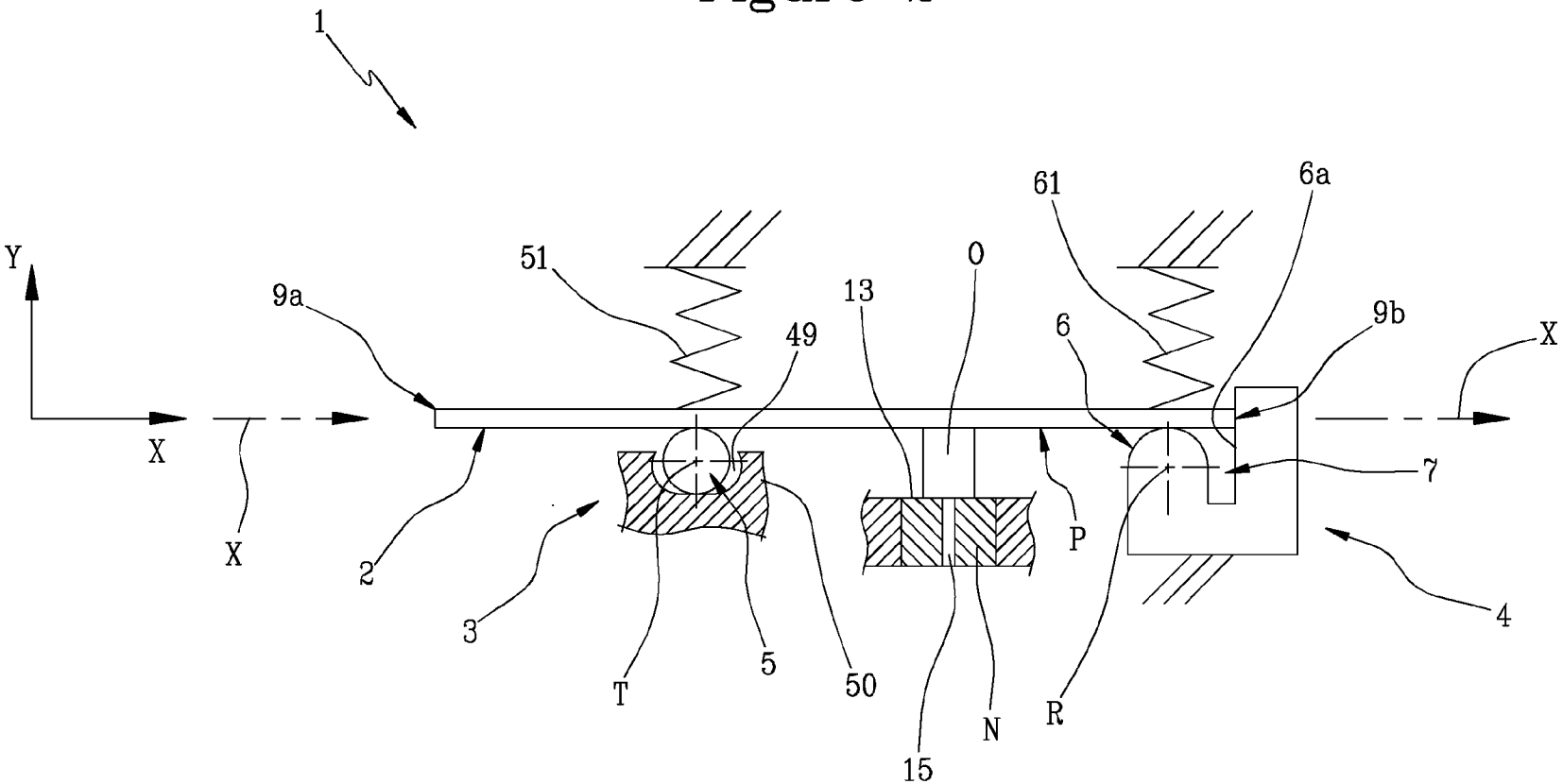
FIG. 2 shows a schematic side view of an actuator according to a first embodiment of the present invention, in a rest configuration.

With particular reference to the first embodiment shown in FIG. 2, the actuator 1 of the present invention comprises a piezoelectric element 2, a first mounting 3 and a second mounting 4, configured to allow the piezoelectric element 2 to be positioned on a reference plane P. The first and the second mountings 3 & 4 can be connected to a support element not illustrated in detail in the drawings.

The piezoelectric element 2 is formed, for example, of lead zirconate titanate (PZT), barium titanate, potassium sodium niobate (KNN) and/or bismuth sodium titanate (BNT) or any suitable material.

The piezoelectric element 2 is a substantially flat rectangular plate comprising one or more piezoelectric layers, configured to deflect in a concave and/or convex direction, whereby the driving and contraction of the ceramic element creates a bending moment that converts a transversal change in length into a large bending displacement perpendicular to the contraction. Such functionality is obtained using known piezoelectric elements, for example, a PICMA® Bender Piezoelectric actuator (e.g. PL112-PL140), which allows for full differential control of the displacement. It will be appreciated that the shape of the element is not restricted to being a rectangular plate, but may be square, disc or any other suitable shape.

The first mounting 3 is structured to allow the piezoelectric element 2 to move freely along a direction of extension/contraction X parallel to the reference plane P, while also allowing it to deflect (bend) upwards or downwards relative to the reference plane P.

Preferably the first mounting 3 allows the piezoelectric element 2 to move both along the direction extension/contraction X (e.g. sliding movement) and in a direction of displacement Y (e.g. bending movement). Such functionality is achieved by the piezoelectric element 2 being free to move tangentially along the roller surface during actuation whilst the piezoelectric element 2 moves/rotates on the roller 5 about the axis T, whereby the roller 5 rotates about the first axis of rotation T.

In the first embodiment shown in FIG. 2, the first mounting 3 comprises a roller 5 located below the piezoelectric element 2. The roller 5 may be fabricated from any suitable material which inter alia is resistant to wear, which is readily machinable using known fabrication techniques, and/or which has a Young's modulus which means it is resistant to deformation by a material in contact therewith. Such material includes (Young's modulus in parentheses), Nitrile butadiene rubber NBR 60 Shore A (0.5 GPa), polyether ether ketone (PEEK) (~2 GPa), reinforced polymers, stainless steel, titanium, glass etc (>10 Gpa).

The roller 5 is configured to rotate about the first axis of rotation T, which is substantially perpendicular to the direction of extension X, whilst the roller 5 is further configured for rolling substantially in the direction of extension X.

The roller 5 is formed of a shape suitable for rotation, for example the roller 5 may be machined to be spherical, oval or cylindrical in shape, whereby it is housed in a groove 49 formed in a support element 50, which is open at the top and extends along a direction parallel to the first axis of rotation T.

At least an upper portion of the roller 5 projects outside the groove 49 such that the piezoelectric element 2 can be placed on top thereof and in contact therewith, such that the piezoelectric element 2 locates on the plane P.

In the preferred embodiment, the groove 49 has a profile elongated in a direction perpendicular to the direction of extension X, and is adapted to receive the roller 5 therein such that the roller 5 can roll inside the groove 49 to facilitate movement of the piezoelectric element in the X and Y directions, whilst minimising frictional wear/damage between the surface of the element 2 and the roller 5.

Alternatively, the mounting 3 may comprise a plurality of grooves or cavities formed in an array perpendicular to the direction of extension X having other forms of rotatable elements contained therein and rotatable in the direction of extension/contraction X, such as e.g. a plurality of individual rollers, stainless steel and/or PEEK ball bearings or oval elements, which would provide similar functionality as the individual roller 5.

Therefore, it will be appreciated that the first mounting 3 is adapted to reduce wear between the piezoelectric element 2 and the mounting 3 during deflection of the piezoelectric element 2, whilst the piezoelectric element 2 is free to move along the direction of extension X and deflected in the direction Y.

The first mounting 3 further comprises an elastic element 51 configured to exert a force on the piezoelectric element 2 in order to press the piezoelectric element 2 against the roller 5 and maintain the piezoelectric element 2 in contact with the roller 5 during deflection of the piezoelectric element 2. The elastic element 51 is preferably made at least partially of an elastomeric material e.g. formed of NBR 60 Shore A.

Alternatively the elastic material 51 comprises a metal or a plastics material or a composite structure comprising a metal/plastics material body having an elastomeric outer surface e.g. Stainless Steel or PEEK covered by an NBR 60 Shore A material.

In an alternative embodiment, a rigid, non-deformable material, may be used for the elastic element 51.

Preferably, the elastic element 51 is optimized to reduce any energy-dissipating effects, so as not to alter/affect the functionality of the piezoelectric element 2 during actuation, for example by minimising the surface area of the elastic element 51 in contact with the piezoelectric element 2 and by ensuring that the elastic element 51 can move in both directions X and Y to maintain the piezoelectric element 2 in contact with the roller 5 along the radius of the roller 5 during deformation of the piezoelectric element 2.

The second mounting 4 comprises a surface 6 having a substantially arched shape, arranged below the piezoelectric element 2 and arranged to allow the piezoelectric element 2 to locate on the plane P, and to move tangentially across the surface 6 of the substantially arched shape, such that the piezoelectric element 2 moves/rotates about an axis R.

It will be appreciated that the height of the arched surface 6 is such that a bottom surface of the piezoelectric element 2 located on the roller 5 and surface 6 is located substantially on the plane P.

The arched surface 6 is structured so that the piezoelectric element 2 moves along it with minimised friction therebetween, thereby reducing frictional wear between the surface of the element 2 and the mounting 4 and maximising the movement of the piezoelectric element 2 in the X and Y directions. The arched surface 6 is preferably formed of a non-deformable material e.g. Polyether ether ketone (PEEK), Stainless steel, Titanium etc.

The second mounting 4 further comprises a stop surface **6*a*, adapted to allow the piezoelectric element 2** to be positioned along the direction of extension X, and retained in position thereon.

In particular, the piezoelectric element 2 can be arranged on the roller 5 and the arched surface 6 with one of its ends **9*b* in contact with the stop surface 6*a*. This allows the piezoelectric element 2** to be positioned precisely during assembly with respect to the direction of extension X.

Preferably the stop surface **6*a* is provided at a distance from the arched surface 6, so that a space 7** is formed between them.

This configuration provides for minimised interference between the piezoelectric element 2 and the mountings 3 & 4 during deformation of the piezoelectric element 2, since the end 9*b* which is initially in contact with the stop surface 6*a* is free to move, at least partly, inside the space 7 during deformation of the actuator 1. It will be appreciated that the space 7 may comprise air, and/or may comprise a material which does not restrict the deformation/deflection of the piezoelectric element 2 into the space 7 e.g. a fluid/an elastomeric material.

Furthermore, the stop surface 6*a* allows for precise placement of the piezoelectric element 2 on the mountings 3 and 4, whilst reducing the impact of manufacturing tolerances on the operation of the actuator 1 for example, due to variations in the length of the piezoelectric element 2 and/or variations in the positioning of the mountings 3 and 4 relative to each other.

Specifically, the piezoelectric element 2 can be placed on the mountings 3 and 4, such that its surface 9*b* is in contact with the stop surface 6*a*. Such placement of the piezoelectric element 2 in contact with a fixed surface is easily and readily achievable. The stop surface 6*a* is therefore useful for initial placement of the piezoelectric element 2. By defining the length of the piezoelectric element 2 to be in contact with the roller 5 and the arched surface 6, and providing a space 7 to accommodate the movement of surface 9*b*, variations in length of the piezoelectric element 2 can easily be accounted for and addressed.

Furthermore, by defining the length of the piezoelectric element 2 to be between the support elements 5 and 6, the mid-point location of the piezoelectric element 2 can easily be defined such that a mechanical coupling can be attached thereto e.g. an obturator, thus simplifying the assembly of the piezoelectric element 2 onto the actuator 1 whilst providing precise positioning thereof.

The second mounting 4 also comprises an elastic element 61 configured for exerting a force on the piezoelectric element 2 to press it into contact with the substantially arched surface 6 during deflection of the piezoelectric element 2. The elastic element 61 is made at least partially of an elastomeric material e.g. NBR 60 Shore A.

Alternatively the elastic material 61 comprises a metal or a plastics material or a composite structure comprising a metal/plastics material body having an elastomeric outer surface e.g. Stainless Steel or PEEK covered by an NBR 60 Shore A material.

In an alternative embodiment, a rigid, non-deformable material, may be used for the elastic element 61.

The function and the advantages of the elastic element 61 of the second mounting 4 are the same as have already been described in relation to the elastic element 51 of the first mounting 3, in that the element 61 exerts a pressure on the piezoelectric element 2 to maintain it in contact with the surface 6 during deformation of the piezoelectric element 2.

Figure 3:
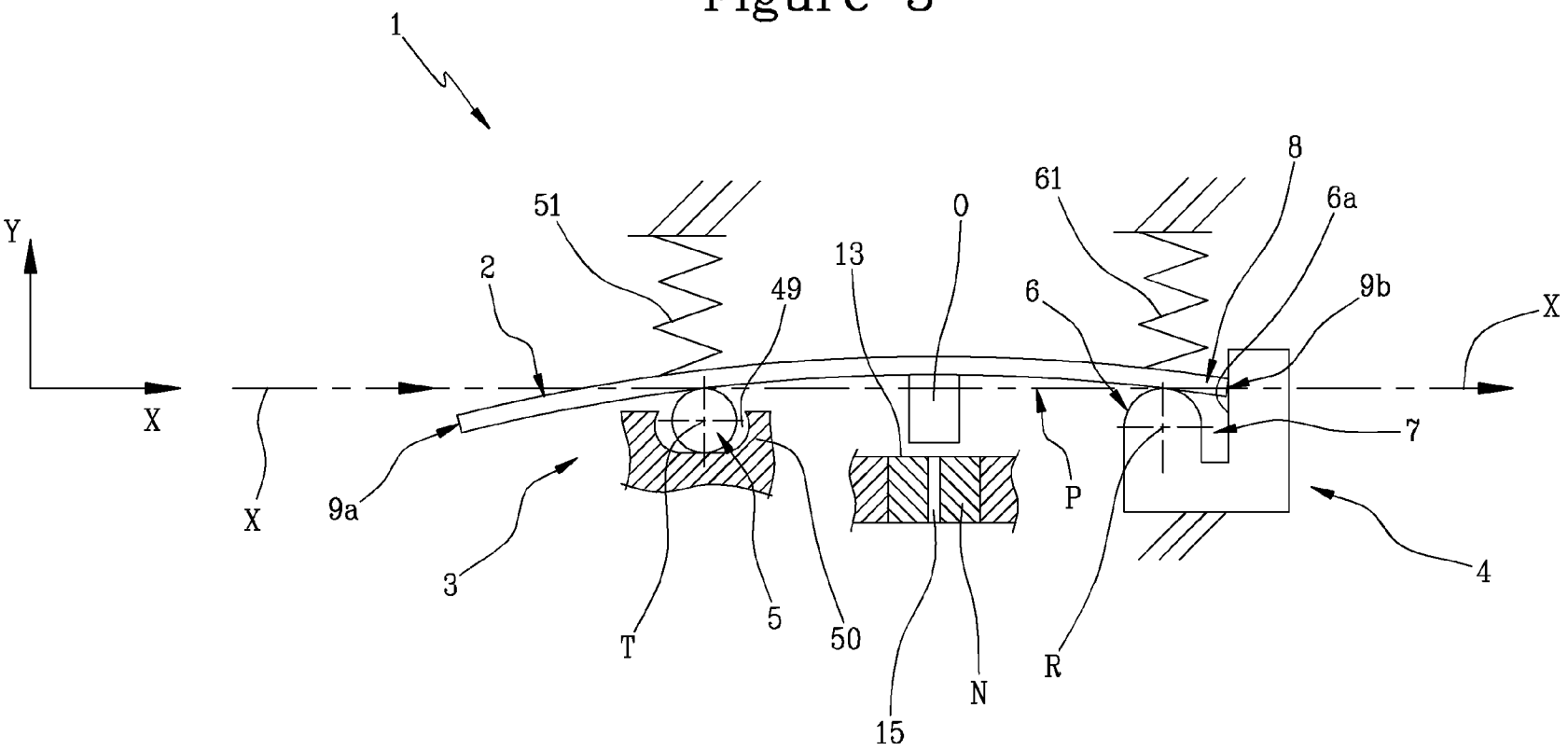
FIG. 3 shows a schematic side view of the actuator of FIG. 2 in an intermediate configuration of deformation.
Figure 4:
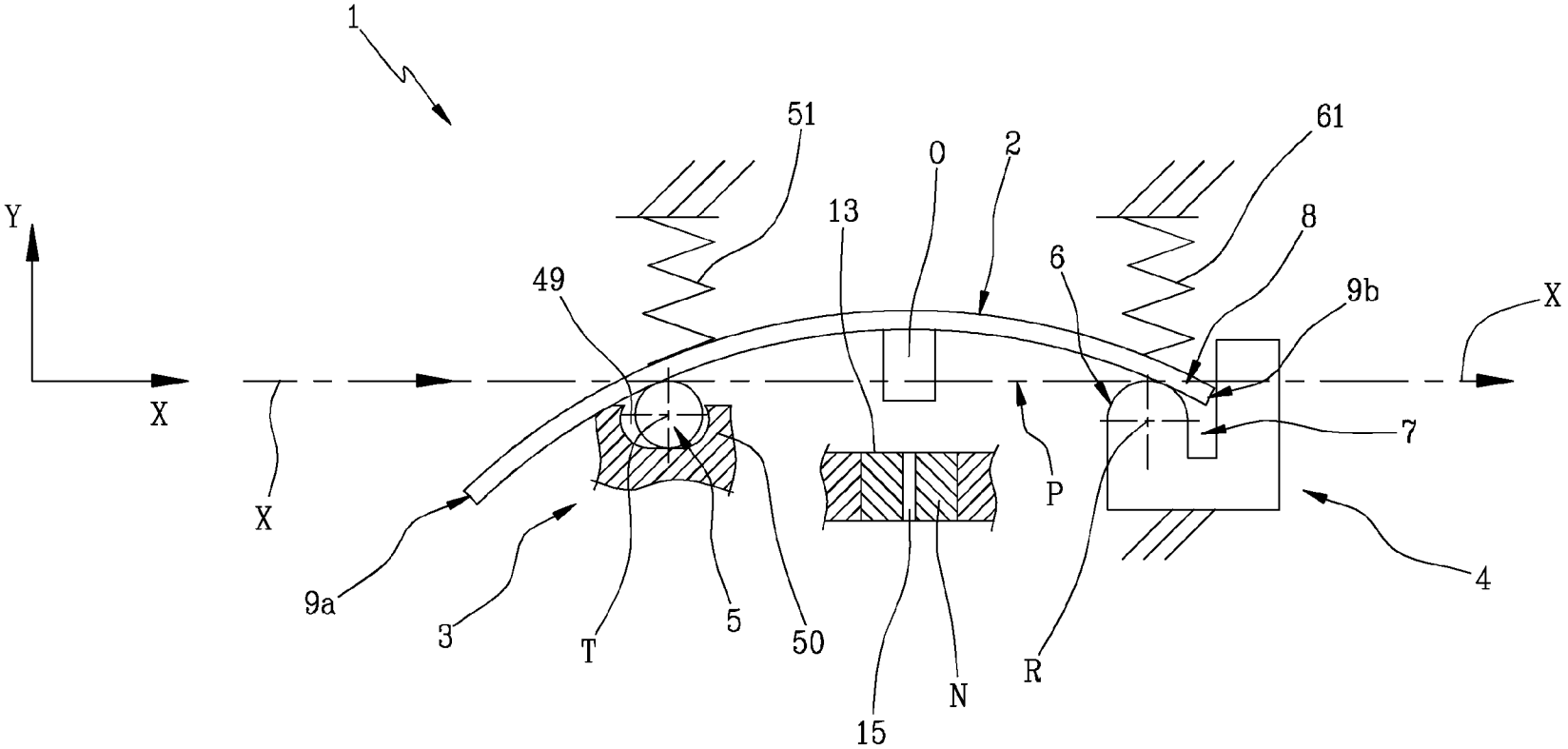
FIG. 4 shows a schematic side view of the actuator of FIG. 2 in a configuration of maximum deformation.

Whilst it will be seen that in the present embodiment as described at FIGS. 2-4, the second mounting 4 does not comprise a roller 5, but instead discloses a fixed arched surface 6, it will be appreciated that, in further embodiments, the mounting 4 could be replaced with a roller 5 substantially as described above without affecting the functionality of mountings 3, or that the fixed arch surface 6 could be replaced with a flat or pointed surface, configured to support the piezoelectric element 2 in position on the plane P, without affecting the functionality of the first mounting 3. Alternatively the mounting 4 may be replaced with an adhesive or mechanical coupling, with the sole function of maintaining an end portion of the piezoelectric element 2 in position on the plane P.

Preferably both the roller 5 and the arched surface 6 are formed substantially of a non-deformable material having a Young's modulus of, for example: >0.5 GPa, and preferably having a Young's modulus greater than 2 GPa e.g. polyether ether ketone (PEEK), and even preferably having a Young's modulus greater than 10 GPa such as stainless steel, titanium, reinforced polymers, glass etc. This allows the position and angle of the tangent formed by the bottom surface of the piezoelectric element 2 relative to the roller 5 and arched surface 6 to be substantially maintained following deformation of the piezoelectric element 2.

The second mounting 4 is structured to allow the piezoelectric element 2 to move along the direction of extension X and to deflect in the direction of displacement Y. The piezoelectric element 2 is also prevented from moving excessively in the direction of extension X by the second mounting 4, and in particular by the surface 6*a* and by the downward force exerted by the elastic element 61.

An actuator 1 provided with the functionality described above provides improved displacement and repeatability of operation of the piezoelectric element 2, whilst minimizing wear at the contact surfaces between the piezoelectric element 2 and the first and second mountings 3 & 4.

In fact, the piezoelectric element 2 is positioned with respect to reference elements, represented by the first and the second mountings 3 & 4, whose positions with respect to the reference plane P can be precisely defined and do not depend on the uncertainties related to the production process of the piezoelectric element 2 and/or the mountings 3 & 4 (for example, variations in the manufacturing tolerances).

Preferably the first mounting 3 is arranged in an intermediate position between a first end 9*a* of the piezoelectric element 2 and a second end 9*b* of the piezoelectric element 2.

The second mounting 4 is preferably positioned between the first mounting 3 and the second end 9*b*, and in proximity to a second end 9*b* of the piezoelectric element 2.

In FIG. 2 the piezoelectric element 2 is shown in a substantially undeformed configuration i.e. a rest configuration, arranged parallel to the direction of extension X, supported on the first mounting 3 and the second mounting 4 on the reference plane P, on which the lower surface of the piezoelectric element 2 is located.

In FIG. 4, the piezoelectric element 2 is shown in a first deformed configuration in which it assumes a concave shape with respect to the reference plane P e.g. when a voltage differential (ΔV) V1 is provided across the piezoelectric element 2 to provide upward deflection i.e. substantially perpendicular to the plane P of e.g. approximately 30 μm.

In passing from the rest configuration to the first deformed configuration on application of the voltage differential, the piezoelectric element 2 is operable to bend in a direction substantially vertically upwards (in the Y direction) from a surface of nozzle portion 13 and to roll with reduced friction between the piezoelectric element 2 and the roller 5 and the arched surface 6.

In FIG. 3 the piezoelectric element 2 is shown in an intermediate deformed configuration e.g. when a voltage differential between V0 and V1 is applied across the piezoelectric element 2 to provide upward deflection substantially vertically upwards relative to the plane P (in the Y direction).

As schematically illustrated in FIGS. 3 and 4, when the piezoelectric element 2 assumes an arched configuration, the second end 9*b* is positioned at least partially inside the space 7. In this way the piezoelectric element 2 does not interfere, with the stop surface 6*a* and, consequently, does not undergo undesired stresses, whilst the mountings 3 and 4 provide for reduced frictional wear on the piezoelectric element 2, thereby increasing the lifetime of the actuator 1.

It will be appreciated that the piezoelectric element 2 as illustrated in FIGS. 3 and 4 is not restricted to upwards deflection, but may also be configured to operate in the downward deflection, or in a bimorph mode using both upward and downward deflection.

Figure 5:
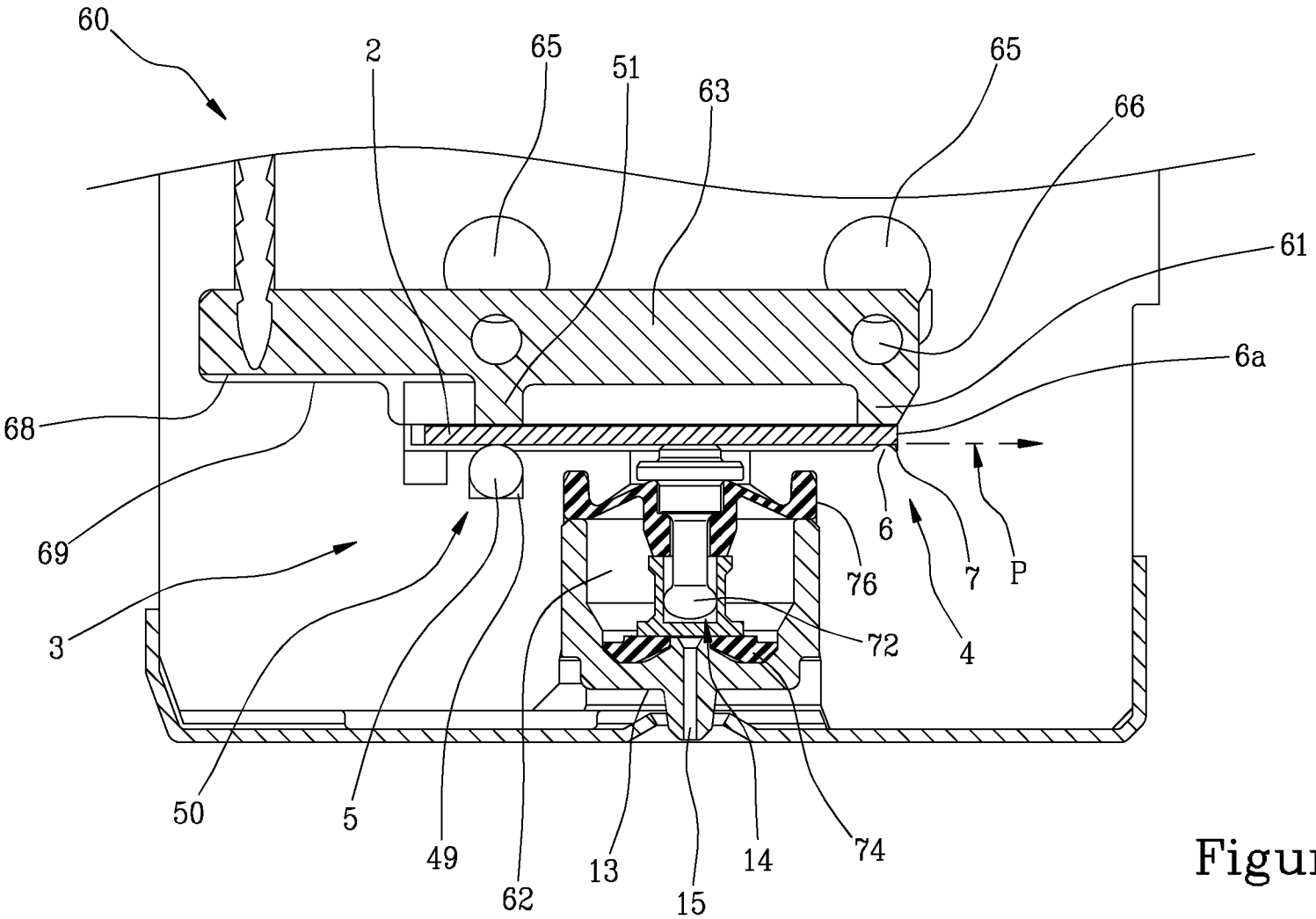
FIG. 5 shows in section a printhead having the actuator of FIG. 2 therein.

The actuator 1 described above can be used in various applications. For example as shown in FIG. 5, the actuator 1 according to the present invention is particularly suitable for controlling an obturator (O) 14 in an inkjet printhead 60, to provide controlled deposition of droplets from the printhead onto the surface of a substrate (not shown), for example for the decoration of ceramic tiles, when using fluids such as glaze.

Whilst the operation of the printhead 60 is hereinafter described in FIG. 5 using glaze, it will be appreciated that any suitable fluid could be used depending on the specific application e.g. methyl ethyl ketone or acetone based ink for printing on cardboard/paper/food packaging, a polymer/metallic based ink for 3D-printing, engobe for printing on ceramics, or a food based fluid such as chocolate.

The glaze itself may contain pigment to provide colour after firing, and have other additives such as clay to provide different finishes such as glossy, matt, opaque finishes that may be combined on the same surface, as well as special effects such as metallic tones and lustre. Texture or relief structures can be provided by printing a solution containing predominantly engobe. An exemplary digital glaze composition is disclosed in ES2386267. Particle sizes within the glaze are generally in the range of between 0.1 μm-40 μm, but preferably up to 10 μm, and more preferably the glaze has a particle size distribution whereby $D_{90}$<6 μm.

Alternatively engobe may be used in the printhead, whereby, as will be appreciated by a person skilled in the art, engobe is used to provide a consistent clean canvass or profile on the surface of the tile.

Engobe is a clay particle suspension, whilst glaze generally comprises an aqueous or solvent based glass frit suspension, or a suspension within a solution, made up of a liquid part having a quantity of mineral particulates/powders dispersed therein, whereby the specific glaze formulation is dependent on the requirements of the end user. A glaze may also contain engobe.

The printhead comprises a fluid chamber, designed to contain the glaze to be deposited on a substrate, whereby the glaze is supplied to the chamber from a controlled glaze supply system via an inlet and an outlet at a pressure of e.g. 0.1 Bar-10 Bar, and preferably, wherein the pressure is preferably between 0.5 and 1.5 Bar, and preferably substantially equal to 1 Bar.

FIG. 5 is a section view of a printhead 60 having the actuator 1 located therein above a fluid chamber 62, whereby the numbering for like parts described above in FIGS. 2-4 is maintained. The body of the printhead 60 is formed of a suitably hard and machineable and/or mouldable material such as Victrex PEEK 150GL30.

The actuator 1 comprises piezoelectric element 2, first mounting 3 and a second mounting 4, configured to allow the piezoelectric element 2 to be positioned on a reference plane P.

In the embodiment shown in FIG. 5, the first mounting 3 comprises a single stainless steel roller 5 located in groove 49 formed in the support element 50, which is formed in part of the body of the printhead 60 below the piezoelectric element 2.

The second mounting 4 comprises a surface 6 of substantially arched shape, arranged below the piezoelectric element 2. The surface 6 is formed as part of the body of the printhead 60. As described above, the surface 6 is structured such that the piezoelectric element 2 moves about the surface 6 with minimum friction, thereby minimising wear.

In an alternative embodiment the groove 49 does not allow the roller 5 to move laterally in the direction X, but only to rotate about the axis T. Therefore the distance between the roller 5 and the surface 6 is fixed throughout deflection of the piezoelectric element 2, thereby defining the length of the piezoelectric element 2 between mounting surfaces 5 and 6 with even further precision throughout the deflection of the piezoelectric element 2.

The first mounting 3 further comprises an elastic element 51 configured for exerting a pressure on the piezoelectric element 2 in order to maintain the piezoelectric element 2 in contact with the roller 5 during deformation of the piezoelectric element 2.

The second mounting 4 further comprises stop surface 6*a* (described above in relation to FIGS. 2-4), structured for allowing the piezoelectric element 2 to be positioned along the direction of extension X, and retained in position therein, whereby, the piezoelectric element 2 is arranged with one of its ends 9*b* in contact with the stop surface 6*a*.

During assembly, the piezoelectric element 2 is placed atop the roller 5 and the surface 6, and positioned thereon such that the surface 9*b* abuts the surface 6*a*. A space 7 is formed between the surface 6*a* and the arched surface 6.

By defining the length of the piezoelectric element 2 required to be located between the support elements 5 and 6, the mid-point location of the piezoelectric element 2 can be easily defined, such that mechanical coupling of an obturator thereto is readily achieved in a precise manner e.g. using an adhesive, thus simplifying the assembly of the actuator 1 and the printhead 60.

The second mounting 4 of printhead 60 also comprises an elastic element 61 configured for exerting a force on the piezoelectric element 2 which maintains it in contact with the surface 6 during deformation of the piezoelectric element 2.

In the present embodiment, the elastic elements 51 and 61 are each formed as part of a deformable cushion 63 formed of e.g. elastomeric material such as NBR 60 Shore A. The cushion 63 is further retained in position by two retaining structures 65 (e.g. stainless steel pins/dowels) attached to the printhead body 60. The retaining pins 65 locate atop the surface of the cushion 63 during assembly and depress into a channel(s) 66 (e.g. a through-hole channel) formed within the body of the cushion 63 and formed to align with the pins 65 when the cushion 63 is assembled into the printhead 60. Such functionality ensures that the elastic elements 51 and 61 are sufficiently depressed against the surface of the piezoelectric element 2, whilst the pins 65 depress into the channel(s) 66 thereby providing for a dissipation of energy as required e.g. when the actuator deflects the cushion 63 upwards towards the pins 65 via elastic elements 51 and 61. In alternative embodiments the elastic elements 51 and 61 may be formed as individual/discrete cushion elements.

The cushion 63 further comprises at least one further channel 68 therethrough which allows for an electrical connection to be established with at least one electrode 69 of the piezoelectric element 2.

In the present embodiment, ejection of glaze from a fluid chamber 62 is controlled by means of an obturator 14 configured to move between a closed position i.e. rest configuration, in which the obturator 14 is in sufficient proximity to the nozzle portion 13 to prevent/restrict the flow of glaze into the nozzle 15 (as shown in FIG. 2), and an open position, intermediate deformed configuration (FIG. 3) and first deformed configuration (FIG. 4), in which the obturator 14 is displaced/retracted vertically upwards from the nozzle portion 13.

The obturator 14 is formed of a connecting rod 72 formed of e.g. Polyetherimide (PEI) such as Ultem 1000 and a valve head 74 formed e.g. of Titanium Grade 5, whereby the connecting rod 72 is secured to the piezoelectric element 1 using a suitable adhesive which is chemically resistant to glaze e.g. Loctite 438, and whereby the distal end of the connecting rod 72 is secured to the valve head 74 e.g. using Loctite 438. The connecting rod 72 extends from the piezoelectric element 2 through a flexible diaphragm 76 into a fluid chamber 62 having an entrance to a nozzle 15 therein. It will be seen that the diaphragm 76 provides a seal between the inside of the fluid chamber 62 and the actuator 1.

The glaze enters the fluid chamber 62 from a fluid manifold (not shown) via a fluid inlet (not shown) and exits the chamber 62 to a fluid manifold via a fluid outlet (not shown). The glaze is maintained at a pressure of e.g. 0.1 Bar-10 Bar, and preferably, the pressure is between 0.5 and 1.5 Bar, and more preferably substantially equal to 1 Bar.

The nozzle 15 provides fluid communication between the inside of the fluid chamber 62 to the exterior of the printhead 60. The valve head 74 is aligned to provide a mechanical seal around the nozzle 15 when the piezoelectric element 2 is in a non-deflected position, thereby closing the nozzle 15 relative to the fluid chamber 62, such that fluid is prevented from flowing into the nozzle 15.

When printing with glaze or engobe the nozzle 6 preferably has a diameter between 100 μm-600 μm, and substantially between 375 μm-425 μm, and preferably substantially the diameter is 400 μm.

However, dependent on the specific application and/or the glaze or engobe used, the diameter may be in the range of 80 μm-1000 μm, to ensure that nozzle 15 does not become clogged by the particles in the glaze, e.g. MEK or Acetone based ink, the diameter may be in a much smaller range e.g. in the order of 10-60 μm.

When the piezoelectric element 2 deforms to the first deformed configuration as shown in FIG. 4, the valve head 74 is displaced substantially vertically upwards in the Y direction from the nozzle portion 13, through the intermediate deformed configuration (FIG. 3), whereby the movement of the valve head 74 is proportional to the level of displacement of the piezoelectric element 2 in the Y direction, whereby a gap is provided between the valve head 74 and nozzle portion 13, thereby opening the nozzle 15 relative to the chamber 62, such that fluid can flow from the chamber 62 into the nozzle 15.

When the piezoelectric element 2 is subsequently returned to its rest position, e.g. as shown in FIG. 2, the obturator closes the inlet of the nozzle 15 relative to the chamber 62 and effects ejection of a drop from the nozzle 15 towards a substrate on the exterior of the printhead, to be deposited on the substrate as a printed pixel.

Repeated operation cycles/oscillation of the piezoelectric element 2 between the rest configuration and the first deformed configuration provides for repeated controlled droplet ejection from the nozzle 15 and controlled droplet deposition onto a substrate if further pixels are required to be printed. If a pixel is not required to be printed, the piezoelectric element 2 is maintained in the rest position.

Figure 6:
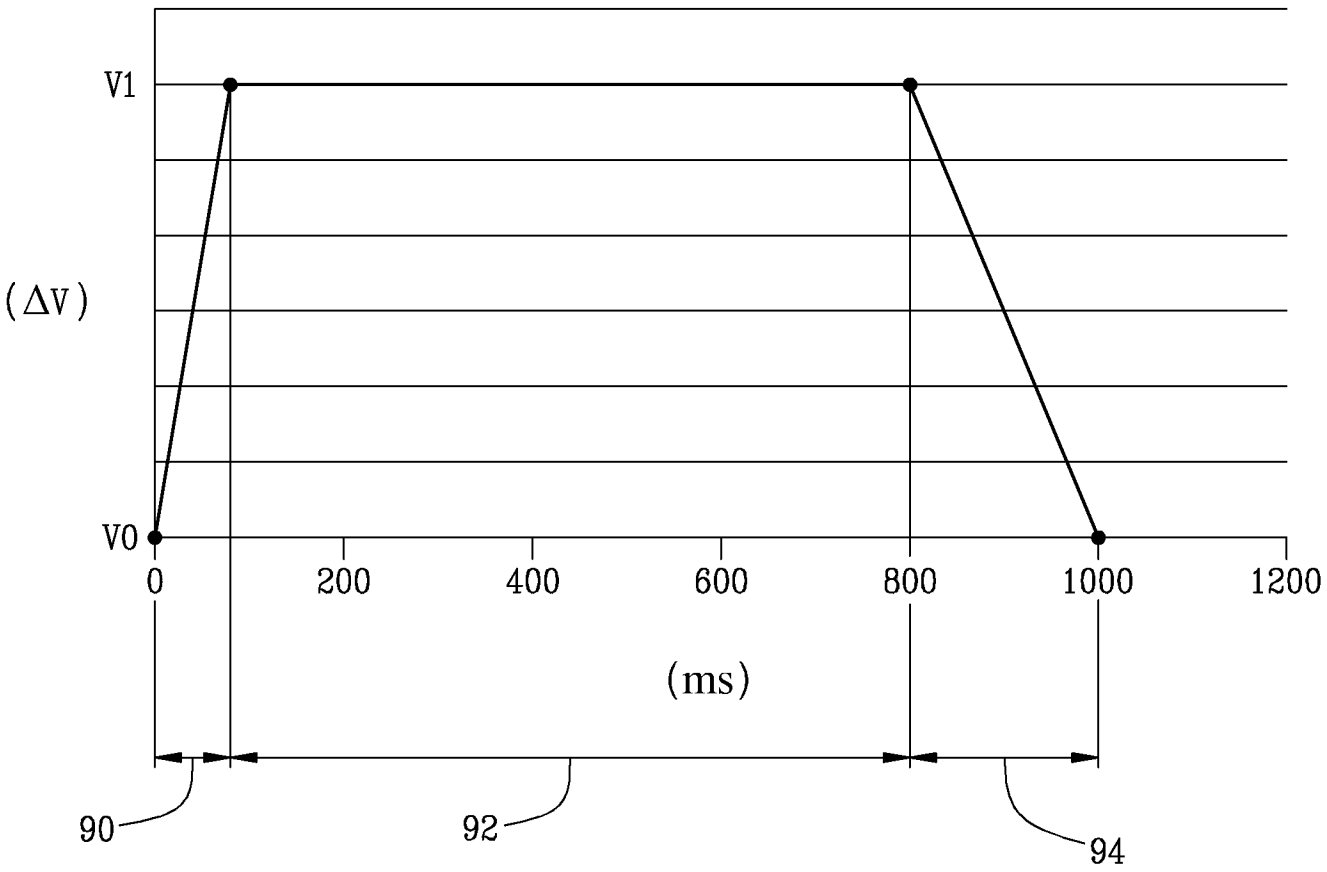
FIG. 6 shows in graphical form, an example waveform of the voltage applied to an actuator of FIGS. 2 to 5.

FIG. 6 shows in graphical form, an example waveform of a voltage differential across the piezoelectric element 2 which is arranged to deflect on application of the voltage differential thereto.

At time 90, the voltage differential (ΔV) across the piezoelectric element 2 is increased from V0 (e.g. approximately 0V) to V1 (e.g. approximately 30V). During this time the piezoelectric element 2 will deform and move/retract substantially vertically upwards in the direction Y e.g. (30 μm), from the rest position as shown at FIG. 2 to the first deformed configuration as shown in FIG. 4, passing through the intermediate deformed configuration as shown at FIG. 3, to provide separation of the valve head 74 from the nozzle portion 13, such that glaze flows into the nozzle 15, whereby the piezoelectric element 2 deforms on the mountings 3 and 4 as described above to provide for reduced frictional wear between the piezoelectric element 2 and the mountings 3 and 4, thereby increasing the lifetime of the actuator 1.

As a result of the reduced friction between the mountings 3 and 4 and the piezoelectric element 2, the configuration described above in FIGS. 2-5 also provides for reduced drive voltage necessary to achieve a given displacement in comparison to conventional printheads.

Furthermore, the provision of the elastic elements 51 and 61 to press the piezoelectric element 2 against the roller 5 and arched surface 6 negates the requirement for an adhesive between the piezoelectric element 2 and the mountings 3 and 4, which removes a possible point of failure in comparison to conventional printheads e.g. due to failure of the glue.

During the period 92, a voltage differential V1 is maintained across the piezoelectric element 2, thereby maintaining the piezoelectric element 2 in the first deformed configuration, whereby the time 92 that the voltage differential is maintained across the piezoelectric element 2 is proportional to the desired drop volume of ink entering the nozzle 15, and therefore the volume of the printed drop.

At time 94, the voltage differential across the piezoelectric element 2 is reduced to V0 and piezoelectric element 2 returns to the rest configuration.

During the return to the rest configuration, the bottom surface of the valve head 74 closes the nozzle 15 and a drop is ejected from the nozzle towards a substrate during the time 94. On the return to the rest configuration the piezoelectric element 2 deforms on the mountings 3 and 4 as described above to provide for reduced wear between the piezoelectric element 2 and the mountings 3 and 4, thereby increasing the lifetime of the actuator 1.

For the present embodiment, the waveform shown in FIG. 6 is repeated at a frequency of e.g. 1 kHz, for as long as drops are required to be ejected from the nozzle i.e. pixels required to be printed. The frequency/drive time (90, 92, 94) may be increased or decreased as required by a user e.g. to increase or decrease the volume of the printed drop, or to increase the frequency of drop ejection from the printhead 20. When a pixel is not required to be printed, the voltage differential is held substantially at V0.

Such deflection can be obtained by applying an appropriate voltage differential across the layer(s) of the piezoelectric element 2 for example, up to approximately 600V, but preferably voltage differentials of up to between 20V to 60V will be applied between layer(s) of the piezoelectric element 2, and preferably up to 30V.

The print head 60 of the present invention comprises the advantage of being both mechanically and electronically adjustable, so that the print head 60 is flexible and versatile, and adaptable to various desired applications, and to various inks e.g. aqueous based and solvent based glazes or engobe. It will also be appreciated that a variety of different inks with different fluid properties could be used by modifying various parameters of the printhead 60 e.g. deflection of the actuator, the nozzle diameter, drive voltage etc. as required.

It will be appreciated that the values used for the above embodiments take the deflection of the piezoelectric elements to be proportional to variations in the applied voltage/voltage differential, i.e. approximately 1 μm deflection per 1V differential, but, as will be appreciated by the skilled person, the relationship and the specific values used will vary dependent on a number of factors including the material and specific crystalline structure/poling of the piezoelectric element and the geometry of the actuator device e.g. length/width/height of the piezoelectric layers. Furthermore, there is no requirement for the relationship between deflection and applied electric field to be linear.

It will be appreciated that any suitable voltage/voltage differential value could be used to provide separation between the obturator and nozzle portion as required by the user, whilst the waveform may comprise one or more steps.

It will be appreciated that whilst piezoelectric elements are described in the embodiments above, whereby the elements are retained towards both ends to allow the elements to deflect in a concave and/or convex direction relative to the reference plane P e.g. arranged as a bimorph, the elements may alternatively be fixed at one end so as function as a cantilever arranged on a single mounting, having an obturator assembly attached thereto to control droplet ejection.

It will also be seen that actuators other than piezoelectric actuators could also be used to provide the same driving functionality to effect droplet ejection, for example electrostatic actuators, magnetic actuators, electrostrictive actuators, thermal uni/bi morph elements, solenoids, shape memory alloys etc. could readily be used to provide the functionality described above whilst obtaining the desirable functionality as will be apparent to the skilled person upon reading the above specification.

All the advantages offered by the piezoelectric element according to the present invention also reflect positively on the printhead which uses the actuator itself to control its own obturator. The precise positioning of the piezoelectric element and the reduction of wear also allows for precise positioning and operation of the obturator. This makes it possible to obtain precise and reliable control of the emission of fluid through the printhead nozzle, thereby providing precise and well-defined printing capabilities, whilst improving the lifetime of the printhead.

It will be seen that a printhead may comprise a plurality of fluid chambers each having one or more nozzles or a printhead may comprise a single fluid chamber having a plurality of nozzles, whereby the nozzles may be opened/closed by individually addressable obturators. Alternatively, a printhead may have a single nozzle provided therein.

Furthermore, the pressures values described above relate to gauge pressure. However it will be appreciated that absolute pressure may also be used as a measurement of the pressure in the system.

The invention claimed is:

1. An actuator (1) for a printhead comprising:

a piezoelectric actuator element (2) made of piezoelectric material;

a first mounting (3) and a second mounting (4), configured for allowing the piezoelectric actuator element (2) to be positioned on a reference plane (P); characterized in that:

the piezoelectric actuator element (2) has a first surface and an opposite second surface;

the first mounting (3) is operable to allow the piezoelectric actuator element (2) to move in a direction (X) substantially parallel to the reference plane (P) and to allow a portion of a first end of the piezoelectric actuator element (2) to rotate about a first axis of rotation (T) substantially perpendicular to the direction (X); wherein the second mounting (4) comprises an elastic element in contact with the first surface of the piezoelectric actuator element (2), the elastic element exerting a biasing force on the first surface of the piezoelectric actuator element (2) which biases the piezoelectric actuator element (2) in a direction towards the reference plane (P).

2. The actuator (1) according to claim 1 wherein the piezoelectric actuator element (2) has an elongated structure.

3. The actuator according to claim 1, wherein the second mounting (4) is configured to allow a portion of a second end of the piezoelectric actuator element (2) to rotate about a second axis of rotation (R) substantially perpendicular to the direction (X) and parallel to the first axis of rotation (T).

4. The actuator (1) according to claim 3, wherein the second mounting (4) comprises a surface of substantially arched shape (6), arranged to maintain the piezoelectric actuator element (2) on the reference plane (P) and structured to allow the piezoelectric actuator element (2) to rotate about the second axis of rotation (R).

5. The actuator (1) according to claim 4, wherein the first mounting (3) comprises a roller (5) having a central axis, operable to rotate about the first axis of rotation (T); and wherein said piezoelectric actuator element (2) is operable to roll without scraping on said roller (5) of said first mounting (3) and to roll without scraping on said surface of substantially arched shape (6) of said second mounting (4).

6. The actuator (1) according to claim 4, wherein the elastic element presses the piezoelectric actuator element (2) into contact with said surface of substantially arched shape (6).

7. The actuator (1) according to claim 6, wherein said elastic element is made at least partly of an elastomeric material.

8. The actuator (1) according to claim 6, wherein the second mounting (4) comprises a stop surface (6*a*), operable to allow the piezoelectric actuator element (2) to be positioned along the direction (X).

9. The actuator (1) according to claim 8, wherein said second mounting (4) comprises a space (7) configured for housing inside it at least one end portion of the first or second end of said piezoelectric actuator element (2) during its said rotation about the second axis of rotation (R).

10. The actuator (1) according to claim 1, wherein the first mounting (3) comprises a roller (5) having a central axis, operable to rotate about the first axis of rotation (T).

11. The actuator (1) according to claim 10, wherein the central axis of the roller (5) is spaced apart from the reference plane (P).

12. The actuator (1) according to claim 10, wherein the roller (5) is configured for rolling in a direction parallel to the direction (X).

13. The actuator (1) according to claim 10, wherein the roller (5) is locatable in a groove (49) which extends along a direction parallel to the first axis of rotation (T), said groove (49) being elongated in a direction perpendicular to the direction (X).

14. The actuator (1) according to claim 10, wherein the first mounting (3) comprises a second elastic element configured to exert a force on the piezoelectric actuator element (2) which presses the piezoelectric actuator element (2) into contact with the roller (5).

15. The actuator (1) according to claim 14, wherein said second elastic element is made at least partially of an elastomeric material.

16. A printhead having at least one actuator (1) as claimed in claim 1.

17. A printer having at least one printhead as claimed in claim 16.

18. A printer having at least one actuator (1) as claimed in claim 1.

19. A method of inkjet printing on a substrate, the method comprising using the printer of claim 18 to deposit a fluid on the substrate.

* * * * *